US005638974A

United States Patent [19]

Mann

[11] Patent Number: 5,638,974

[45] Date of Patent: Jun. 17, 1997

[54] SMALL CONTAINER

[75] Inventor: Horst Mann, Babenhausen, Germany

[73] Assignee: Ferrero offene Handelsgesellschaft mbH, Frankfurt am Main, Germany

[21] Appl. No.: 420,485

[22] Filed: Apr. 12, 1995

[30] Foreign Application Priority Data

Apr. 15, 1994 [DE] Germany ..... 44 13 040.6

[51] Int. Cl.[6] ..... B65D 21/00

[52] U.S. Cl. ..... 220/23.4; 220/23.86

[58] Field of Search ..... 220/23.4, 23.6, 220/23.83, 23.86

[56] References Cited

U.S. PATENT DOCUMENTS

| | | | |
|---|---|---|---|
| 2,753,077 | 7/1956 | Greco . | |
| 3,683,549 | 8/1972 | Simmon | 220/23.4 |
| 3,759,373 | 9/1973 | Werth et al. | 220/23.4 |
| 4,003,491 | 1/1977 | Wells et al. . | |
| 4,133,445 | 1/1979 | Mandelbaum | 220/23.4 |
| 4,228,897 | 10/1980 | Underwood . | |
| 4,234,087 | 11/1980 | Pandak | 220/23.4 |
| 4,860,896 | 8/1989 | Snider | 220/23.4 |
| 4,966,298 | 10/1990 | von Holdt | 220/23.4 |
| 4,982,858 | 1/1991 | von Holdt . | |
| 5,402,903 | 4/1995 | Mann | 220/23.6 |

FOREIGN PATENT DOCUMENTS

| | | |
|---|---|---|
| 3640203 | 8/1987 | Germany . |
| 4119252 | 12/1992 | Germany . |
| 2182304 | 5/1987 | United Kingdom . |

*Primary Examiner*—Joseph M. Moy
*Attorney, Agent, or Firm*—Sughrue, Mion, Zinn, Macpeak & Seas

[57] ABSTRACT

The invention relates to small container (2.1, 2.2), in particular of plastic, including at least one cylindrical, in particular circular cylindrical section with a means (16.1*a* to *c*, 16.2*a* and *b*, 18.2*a* and *b*) located in the region of cylindrical peripheral area of this section for producing a form-locked slide-insertion-connection with at least one further such small container. The invention is characterized in that the container is rollable in the peripheral direction perpendicular to the insertion direction with its means (16.1*a* to *c*, 16.2*a* and *b*, 18.2*a* and *b*) for producing the slide-insertion-connection on a similarly formed means (16.1*a* to 16*c*, 16.2*a* and *b*, 18.2*a* and *b*) of a further such small container and is always held in a form-locked manner in the radial direction during this rolling movement.

8 Claims, 4 Drawing Sheets

SMALL CONTAINER

The present invention relates to a small container, in particular of plastic, including at least one cylindrical, in particular, circular-cylindrical section with a means located in the region of the cylindrical peripheral surface of this section for producing a form-locked slide-insertion-connection with at least one further such small container.

Such a container is known from DE-OS 41 19 252. The small container described in this has a plastic molded body with an upper and a lower part and can hold various objects. The upper and lower parts are separable. The means for producing a form-locked slide-insertion-connection of this small container consists of a plurality of dovetail-shaped recesses and elevations on the container periphery so that several such containers can be rigidly joined together by means of this plug-in or slide connection possibility. In addition to the actual use as a container, i.e. as a transporting and packaging means, the small container can also be used as a connectable building brick of a connectable building brick toy. Such small containers are used, for example, as the contents of hollow bodies such as chocolate eggs and hold, for example, toy parts as surprise articles in their function as a packaging means. In their function as toys in the form of a connectable building brick, several small containers can be joined together in a plurality of combinations, although always only one static shape is produced as a result. These purely static possibilities for combining the small containers do not, however, suffice for use as an interesting and varied toy.

The invention is therefore based on the technical problem of improving a small container of the type initially mentioned in a simple and effective manner such that both a plurality of static as well as movable combination possibilities result and the container can be used in more variations as a toy.

This object is solved by a small container, in particular of plastic, including at least one cylindrical, in particular circular-cylindrical section with a means located in the region of the cylindrical peripheral area of this section for producing a form-locked slide-insertion-connection with at least one further such small container, the small container being characterized in that the small container is rollable in the peripheral direction perpendicular to the sliding direction with its means for producing the slide-insertion-connection on a similarly formed means of a further such small container and is always held in a form-locked manner in the radial direction during this rolling movement.

The advantage of the small container according to the invention lies not only in that several such containers can be statically combined as desired in various directions or dimensions so that the most varied shapes and constructions can be formed, wherein a stable and releasable connection between several small containers is possible, but also in that stable movable structures are simultaneously provided so that the possibilities of use are increased and the playing and enjoyment value is increased.

In the small container according to the invention, it has also proved to be advantageous for this purpose that the means for producing a slide-insertion-connection comprises in a region of the cylindrical peripheral surface of the container alternating, mutually matched recesses and elevations, that the form-locked sliding-insertion-connection is producable by the engagement of at least one elevation in one recess, and that the elevations and recesses are formed and their mutual separation and spacings are selected and adapted to each other such that upon rolling two small containers on one another, the leading elevation in the direction of rolling is already in form-locked engagement with the next recess before the following elevation in the rolling direction engaged at that time in a recess is released out of the form-locked engagement.

This can be particularly usefully realized when the recesses and elevations are designed to be dovetail-shaped. However, the embodiment according to the invention is not limited to this shape.

If the elevations and recesses are continuously arranged about the entire periphery of the small container, a large movement and rolling region can be achieved.

Further, it is of great advantage for the form-locked rollability when the means for producing a slide-insertion-connector is produced from an elastic material.

In order to increase the combination possibilities of several small containers according to the invention and to increase the playing value, it has proved to be of advantage that a coupling element is provided on at least one end face of the small container to produce a releasable connection with at least one further such small container. For this purpose, a coupling element has particularly proved to be suitable which is a bayonet-catch-like component or another suitable plug connection or the like.

It is of considerable use in particular for larger small containers according to the invention that a stop is provided on the small container and/or on the means for producing the slide-insertion-connection so that a slide-insertion-connection can only be produced in one direction of insertion. While the slide-insertion-connection can easily be held by means of the frictional forces occurring at the means for producing this connection in the case of smaller small containers according to the invention, it is possible in the case of larger small containers according to the invention that the slide-insertion-connection is released in a corresponding position of the small container in that a small container overcomes the frictional forces on account of its large weight and slips out of engagement. This is effectively avoided by means of the design measures described above.

An exemplary embodiment of the invention is described in the following by way of further details and advantageous further embodiments with reference to the drawings, in which.

Figure 1:
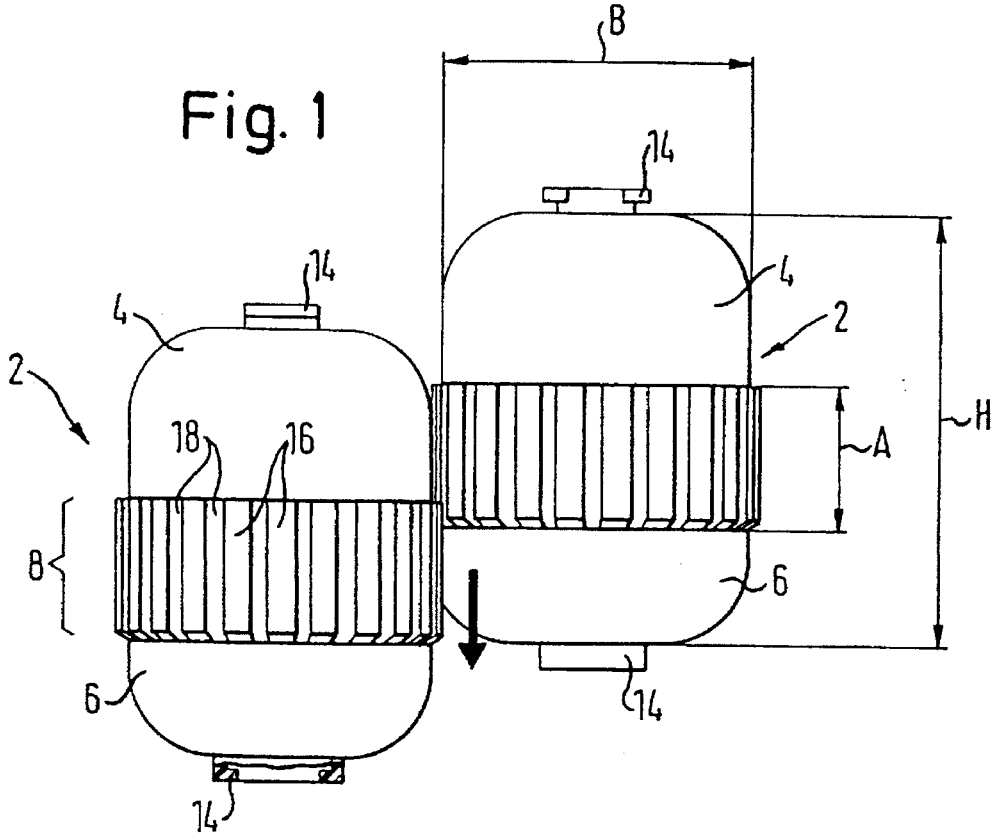
FIG. 1 shows a side view of two inventive small containers according to a first embodiment during the inserting process.

The process of the sliding or insertion into each other of two small containers 2 by means of their means 16, 18 for producing a form-locked slide-insertion-connection is illustrated in FIG. 1. The direction of insertion is indicated by a thick arrow. The means 16, 18 is described in more detail in the following. The small containers 2 have a substantially cylindrical structure and rounded-off ends at the end of the longitudinal side which pass over into flattened end face sections. The shell surfaces of the container 2 are cylindrically formed.

A coupling element 14 is respectively provided at both end face sections of the small container 2 to produce a releasable connection with at least one further small container 2 so that the small containers are connectable in an opposing manner by means of their respective end face sections.

Figure 2:
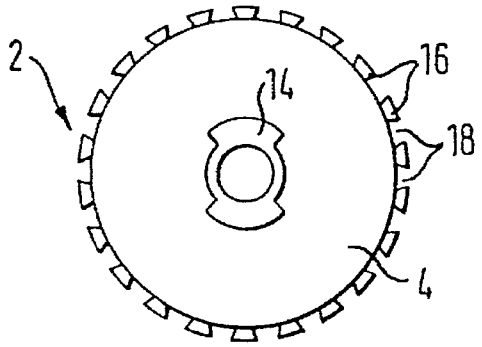
FIG. 2 shows a top plan view of an inventive small container according to the first embodiment.

The small containers 2 have a circular cylindrical section 8, the diameter of which in the present case is slightly larger than the diameter of the small container 2 itself. However, this measure is not imperative and the diameter of the circular cylindrical section 8 can equally have the diameter of the small container 2. In the region of the cylindrical peripheral surface of the section 8, there is provided a means 16, 18 for producing a form-locked slide-insertion-connection with at least one further such small container 2. As can be easily recognized in the top plan view according to FIG. 2, the means 16, 18 for producing a form-locked slide-insertion-connection is arranged continuously around the entire peripheral area of the cylindrical section 8 or of the small container 2, respectively. However, it is equally conceivable to form the means 16, 18 only in a part of the area of the cylindrical section 8 or of the container 2, respectively. In such an embodiment, the mounting of a means for sectionally limiting the rolling movement of two connected containers 2 is possible. For example, this can be a stop.

Figure 3:
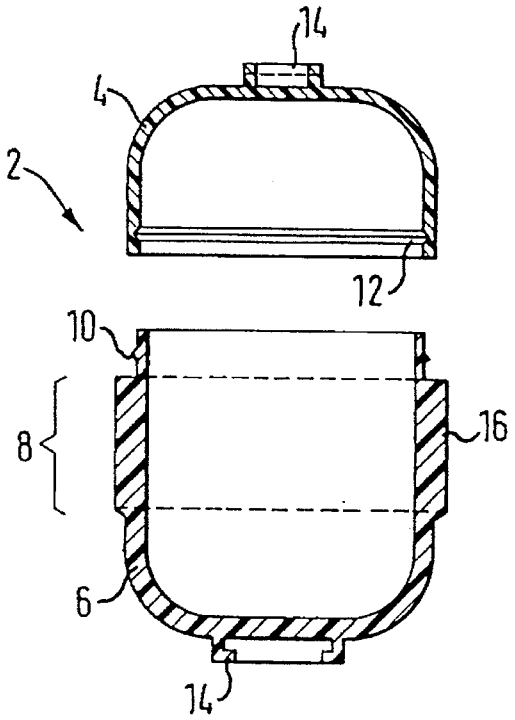
FIG. 3 shows a cross-sectional side view of the container according to FIG. 1.

As can be taken from FIG. 3, the small container 2 has a lid-shaped upper part 4 and a lower part 6. The lower part 6 has a drawn-in edge over which the upper part 4 is placed in a slip-lid fashion. For locking, the drawn-in edge is provided with a bead 10. The upper part 4 has a groove 12 adapted to the bead 10. Upon insertion of the upper part 4 onto the lower part 6, the annular bead 10 engages in the annular groove 2 so that a lock is produced. The shape of the coupling element 14 on the end face sections of the small container 2 is recognizable in FIG. 3 as well as in FIGS. 1 and 2. The coupling element 14 on the lower part 6 of the small container 2 in the present case includes a projection which consists of hook elements arranged on a circle with radially inwardly directed hook ends. The hook elements form a recess. A corresponding projection is provided at the end face section of the upper part 4, the projection being formed in a circular pot-like manner with radially outwardly directed hook elements for insertion into the recesses of the coupling element 14 of the lower part 6 and for bayonet-catch-like rotation into the connected position. A stop can be provided at the end of the connected position.

A further embodiment of the coupling element 14 can be formed, for example, such that again projections matched with each other are provided on the end face sections of the small container 2. In this case, a projection is provided on the upper part 4 which has a knob-like recess. On the other hand, the lower part 6 has a projection which consists of a rim or ring with a circular recess that is larger than the projection of the upper part. The upper part 4 can thus be plugged into the lower part 6. However, it is also possible to make a connection of several similar small containers 2 in the closed state of the small container 2, i.e. after placement of the upper part 4 in a slip-lid manner onto the lower part 6 and engagement of the bead 10 in the groove 12. This takes place in the manner previously described.

As an alternative to the coupling elements 14 described above which are formed respectively differently on the upper part 4 and on the lower part 6 of the small container, other desirably different and suitable plug-in connectors can be used, also similarly formed connectors.

Figure 4:
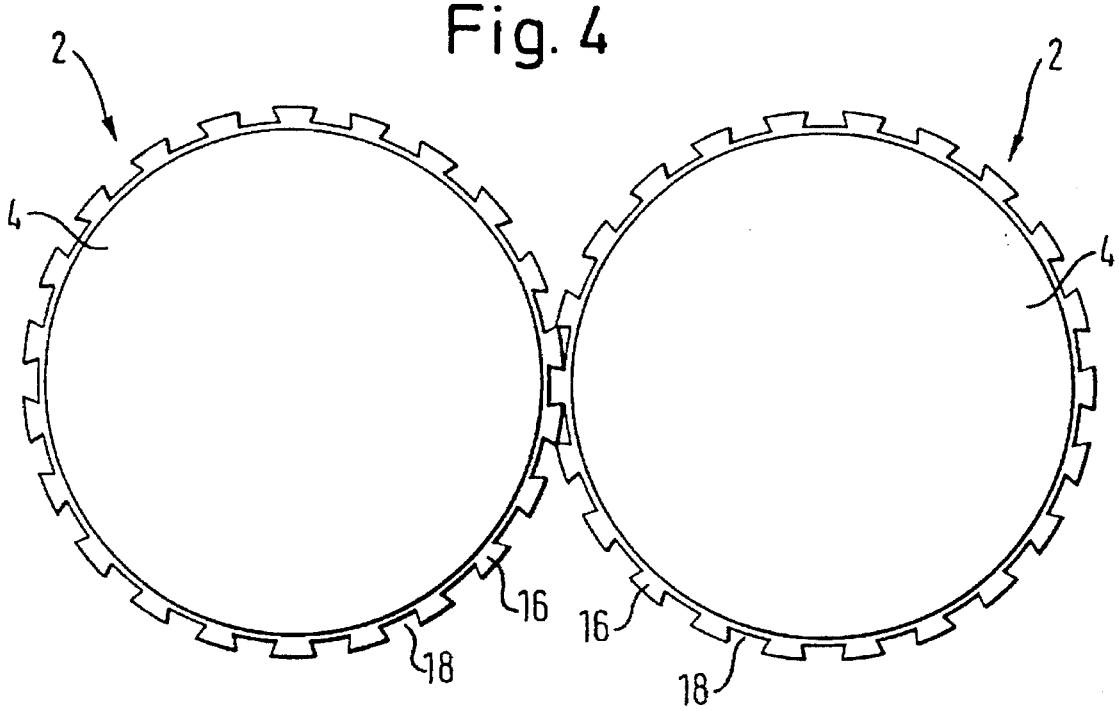
FIG. 4 shows a schematic top plan view of two inventive small containers which are in engagement with each other.

A top plan view of the principle of static engagement of the means 16, 18 for producing a form-locked slide-insertion-connection of two small containers 2 is illustrated in FIG. 4. It can be recognized in the drawing that the means for producing a slide-insertion-connection consists of elevations 16 and recesses 18 arranged alternatively on the circular cylindrical section 8 of the small container 2 continuously about the entire peripheral area of the circular cylindrical section 8 or of the small container 2, respectively. The elevations 16 and the recesses 18 are respectively dovetail-shaped.

Figure 5:
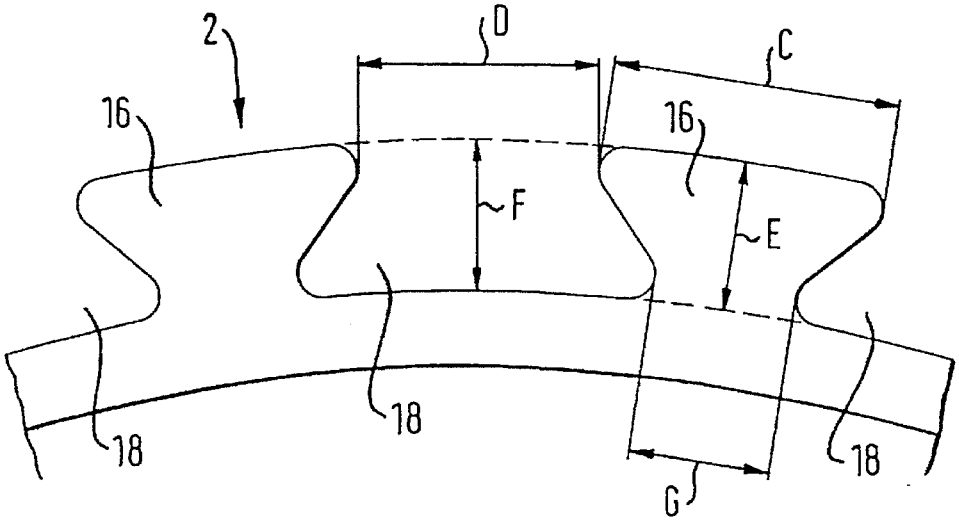
FIG. 5 shows a schematic detailed view of the inventive means for producing a slide-insertion-connection.

FIG. 5 shows the elevations 16 and recesses 18 in further detail. The dimensions of the elevations 16 and the recesses 18 as well as the important dimensions of the small container 2 (see also FIG. 1) forming the basis for the present exemplary embodiment are listed in the following Table 1:

TABLE 1

| Dimensions (mm): | |
|---|---|
| A | 11.5 |
| B | 32 |
| C | 02.9 |
| D | 02.9 |
| E | 01.0 |
| F | 01.0 |
| G | 01.8 |
| H | 45 |

In Table 1, A denotes the length of the means 16, 18 for producing a slide-insertion-connection in its extension along the circular cylindrical section 8, B denotes the width of the small container 2, C denotes the width of the elevation 16 on the peripheral surface, D denotes the width of the recess 18 on the peripheral surface, E denotes the height of the elevation 16 above the base of the recess 18, F denotes the depth of the recess 18 relative to the upper edge of the elevation 16 on the peripheral surface, G denotes the base width of the elevation 16 and H denotes the height of the small container 2.

The mentioned dimensions apply only to the present exemplary embodiment and can vary considerably according to the type of use.

The small container 2 according to the invention comprising the elevations 16 and the recesses 18 is made wholly of plastic, such as polypropylene or ABS. The wall thickness of the small container 2 in the present case amounts to approximately 0.5 to 1.0 mm. In the region of the circular cylindrical section 8 as well as of the coupling element 14, the wall thickness is preferably greater. Depending on the size of the small container, the dimensions can largely deviate from the mentioned values.

The small container 2 with its elevations 16 and recesses 18 forming the means for producing a slide-insertion-connection and arranged alternatively in the region of the cylindrical periphery of the circular cylindrical section 8 and adapted to each other is designed in such a manner that the form-locked slide-insertion-connection is producable by means of the engagement of at least one elevation 16 in one recess 18, and the elevations 16 and recesses 18 are formed and their separation and spacings with respect to each other are selected and matched to each other in such a manner that upon rolling of two such small containers on each other, a leading recess 16 in the rolling direction is already located in form-locked engagement with the next recess 18 before the following elevation 16 in the rolling direction at that time in engagement with a recess 18 goes out of form-locked engagement.

The mode of operation of the form-locked rolling on each other of two small containers 2 according to the invention will now be described with reference to FIGS. 6, 7 and 8.

Figure 6:
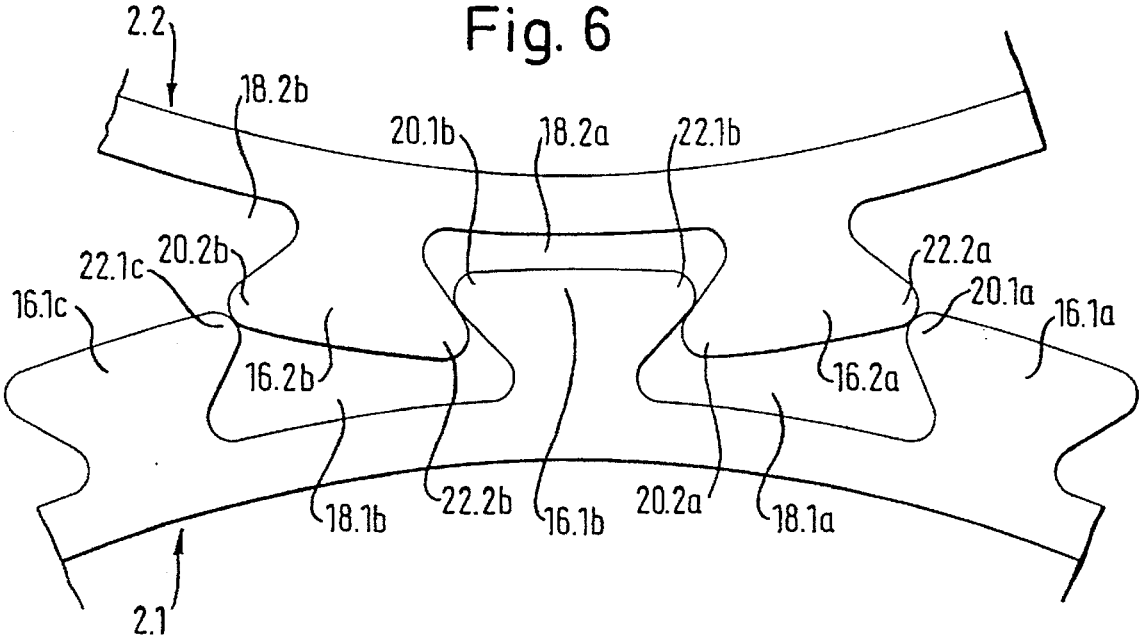
FIG. 6 shows a detailed view of two engaging means for producing the slide-insertion-connection in the static state.

FIG. 6 shows the static, form-locked slide-insertion-connection in both small containers 2.1 and 2.2. In this case, the one elevation 16.1*b* of the small container 2.1 engages in the one recess 18.2*a* of the small container 2.2. The elevations 16.2*a* , 16.2*b* of the small container 2.2 to both sides of the elevation 16.1*b* of the small container 2.1 are both in such a position that their edges 20.2*a* and 22.2*b* surround the elevation 16.1*b* of the small container 2.1, while the edges 22.2*b* and 2o.2*b* slightly overlap the respective edges 20.1*a* and 22.1*c* of the respective elevations 16.1*a* and 16.1*c* respectively located to the sides of the elevation 16.1*b* , which is in engagement. During this overlapping, the mentioned edges can touch or be positioned at a small distance from each other.

Figure 7:
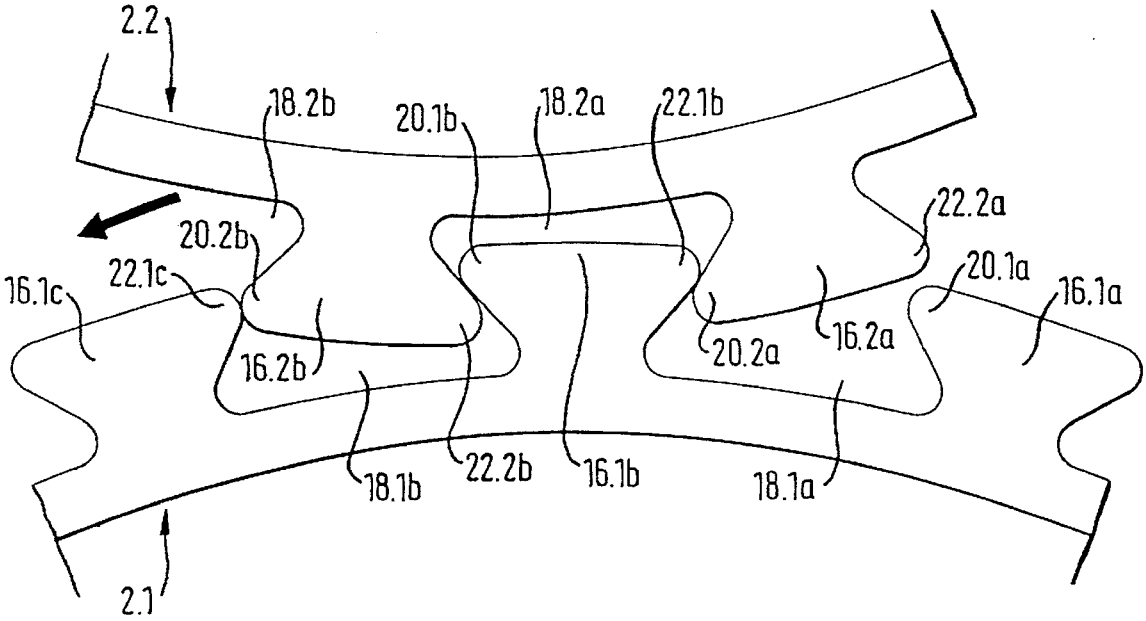
FIG. 7 shows an illustration of the principle of the inventive form-locked rolling process in a first phase.

FIG. 7 represents a phase in which, proceeding from the static stage shown in FIG. 6, a rolling movement can be started perpendicular to the insertion direction and in the peripheral direction of the small containers 2.1, 2.2. The rolling direction is denoted by an arrow. In the present case, the small container 2.1 is fixed while the small container 2.2 rolls on the small container 2.1. Upon starting the rolling movement in the direction denoted by the arrow, the elevation 16.1*b* of the container 2.1 in engagement with the recess 18.2*a* of the container 2.2 is slightly elastically deformed and bent slightly in the direction of rolling. In this case, the edge 20.2*a* of the elevation 16.2*a* following in the rolling direction with respect to the elevation 16.1*b* at that time in engagement with the recess 18.2*a* moves further upwards to the edge 22.1*b*, but in this case still remains in form-locked engagement. At the same time, the elevation 16.2*b* leading in the rolling direction moves to the left in the rolling direction so that its edge 20.2*b* comes to lie on the edge 22.1*c* of the elevation 16.1*c* .

Figure 8:
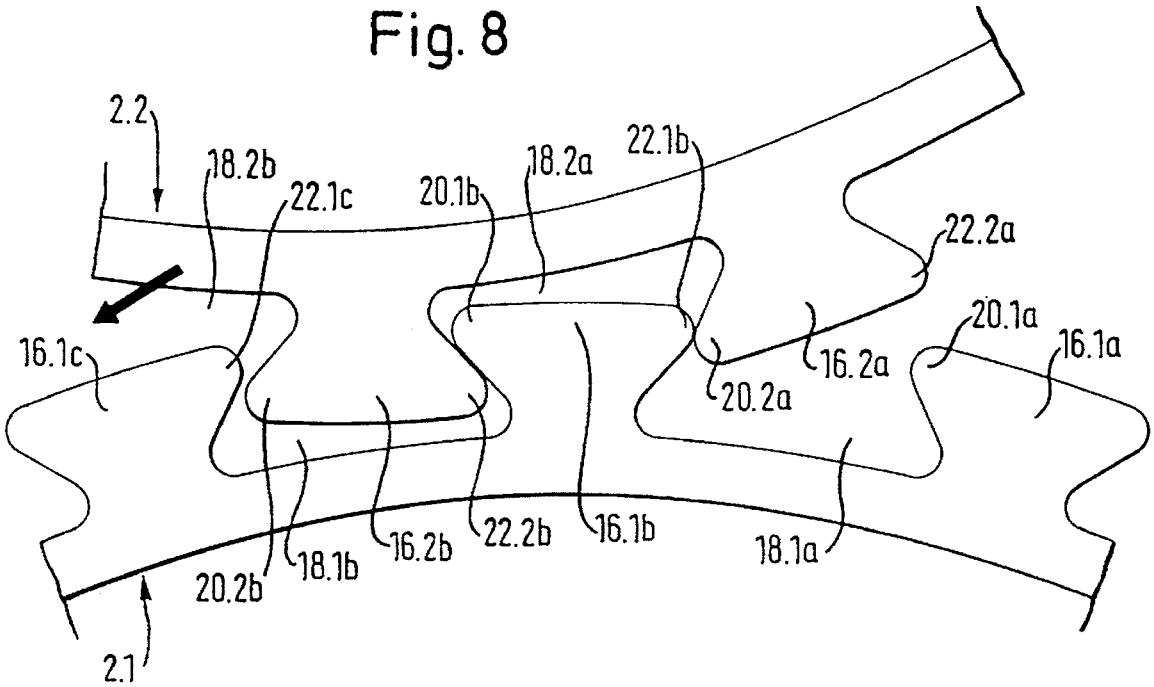
FIG. 8 shows an illustration of the principle of the inventive form-locked rolling process in a second phase.

FIG. 8 shows a phase which follows the condition illustrated in FIG. 7. The rolling direction is again denoted by an arrow. In continuing the rolling movement, the edge 20.2*b* slides over the edge 22.1*c* , slips into the recess 18.1*b* of the small container 2.1 and becomes engaged there. During this process, an elastic deformation of the elevation 16.2*b* can occur. On account of the elastic deformation of the elevation 16.1*b* , elevation 16.2*a* of the small container 2.2 is still in form-locked engagement with this elevation 16.1*b*.

However, as soon as the rolling movement progresses only slightly, the edge 20.2*a* slips over the edge 22.1*b* of the elevation 16.1*b* and releases the engagement. Simultaneously, the elevation 16.2*b* of the container 2.2 is pushed further into the recess 18.1*b* of the small container 2.1. This condition then corresponds to that illustrated in FIG. 6.

The process described above repeats itself in the subsequent stages of the rolling movement. The rolling movement can ensue both in the direction of the arrow illustrated in the figures or in the opposite direction.

It is clear from the preceding explanation of the mode of operation during a rolling process of the small container according to the invention that it is possible to roll two or more inventive small containers on each other in the peripheral direction, the small containers always being held in a form-locked manner in the radial direction without a further connection between the small containers existing other than that via the elevations 16 and the recesses 18. A form-locked engagement also in the tangential direction ensues per se on account of the tooth-like design of the parts 16 and 18. As illustrated in FIGS. 6, 7 and 8, the edges of the elevations 16 and the edges of the recesses 18 can respectively be rounded off. However, depending on the size of the small container, this rounding off can already result from the necessary tolerances for the molding machines of the small container according to the invention. For small containers with larger dimensions, however, it is necessary as a rule to purposefully provide the edges of the elevations and recesses with suitable rounding offs.

Figure 9:
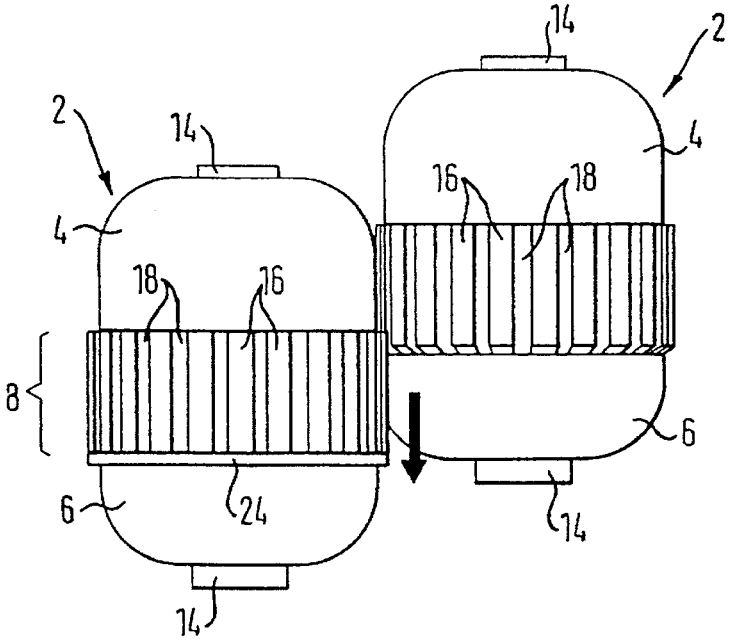
FIG. 9 shows a second embodiment of the small container according to the invention.

FIG. 9 shows a second embodiment of an inventive small container 2. In this variation of the small container, at the end of the circular cylindrical section 8 upon which the means 16, 18 for producing a form-locked slide-insertion-connection is arranged, there is provided a stop 24 in the form of an annular shoulder so that a slide-insertion-connection is only possible in one direction of insertion. In this manner, a small container combined with a small container modified in this manner can no longer slide in the direction of the stop out of the slide-insertion-connection, a danger which exists particularly in the case of larger small containers according to the invention. A widening of the elevation 16 or a narrowing of the recess 16, respectively, or another suitable measure, can also serve as a stop.

The present invention is not limited to the two embodiments described above. Variations and modifications are possible in many ways. For example, the small container can have a rectangular, square or other polygonal form instead of the illustrated round, cylindrical form, a circular cylindrical section then being provided for the means 16, 18 for producing a form-locked slide-insertion-connection in the respectively used shape. The mentioned means including its elevations 16 and recesses 18 can also be provided on the entire periphery of the small container 2 or be limited to certain areas thereof.

The elevations 16 and recesses 18 can additionally have different suitable forms than the described dovetail-shaped design, for example, an asymmetric design is also to be considered.

Additionally, the small container according to the invention can be provided with separate additional parts or additional parts which are stored in the interior of the small container, said additional parts being usable in an appropriate manner with the small container as connectable building bricks of a connectable building brick toy. For this purpose, the small container according to the invention can be provided with additional connection possibilities for slide or insertion connections in several dimensions.

Reference sign list

There is denoted by:

| | |
|---|---|
| 2 | small container |
| 2.1 | small container |
| 2.2 | small container |
| 4 | upper part |
| 6 | lower part |
| 8 | circular cylindrical section |
| 10 | bead |
| 12 | groove |
| 14 | coupling element |
| 16 | elevation |
| 16.1a,b,c | elevation |
| 16.2a,b | elevation |
| 18 | recess |

-continued

| | |
|---|---|
| 18.1a,b | recess |
| 18.2a,b | recess |
| 20.1a,b | edge |
| 20.2a,b | edge |
| 22.1a,b,c | edge |
| 22.2a,b | edge |
| 24 | stop |
| A | length of the means for producing a slide-insertion-connection |
| B | width of the small container 2 |
| C | width of the elevation 16 on the peripheral surface |
| D | width of the recess 18 on the peripheral surface |
| E | height of the elevation 16 |
| F | depth of the recess 18 |
| G | base width of the elevation 16 |
| H | height of the small container 2 |

I claim:

1. A small container comprising a circular cylindrical section having a longitudinal axis and a plurality of connecting means disposed about a peripheral region of said cylindrical section for providing a form-locked slide insertion connection parallel to said axis with at least one further small container having identical connection means wherein, said connecting means are configured to enable rolling engagement of said small container while maintaining the slide insertion connection in a form locked manner to prevent separation in a radial direction during said rolling engagement.

wherein said connecting means for producing a slide insertion connection includes recesses and elevations which alternate in said peripheral region of the cylindrical section of the small container and ar adapted to engage each other.

the form-locked slide insertion connection is obtained by means of engagement of at least one elevation in one recess and the elevations and recesses are formed and their separation and spacing with respect to each other are selected relative to each other such that upon rolling of two small containers on each other, the elevation leading in the direction of rolling is already located in form-locked engagement with the next recess before the elevation following in the direction of rolling and engaged at that time in the recess is released out of the form-locked engagement.

2. Small container according to claim 1, wherein said connecting means for producing a slide insertion connection includes recesses and elevations which alternate in said peripheral region of the cylindrical section of the small container and are adapted to engage each other, the form-locked slide insertion connection is obtained by means of engagement of at least one elevation in one recess and the elevations and recesses are formed and their separation and spacing with respect to each other are selected relative to each other such that upon rolling of two small containers on each other, the elevation leading in the direction of rolling is already located in form-locked engagement with the next recess before the elevation following in the direction of rolling and engaged at that time in the recess is released out of the form-locked engagement.

3. Small container according to claim 1, wherein the recesses and elevations are dovetail-shaped.

4. Small container according to claim 2, wherein the elevations and recesses are arranged continuously about the entire peripheral region of said cylindrical section of the small container.

5. Small container according to claim 1 wherein the connecting means for producing a side insertion connection is made from an elastic material.

6. Small container according to claim 1 wherein a coupling element for producing a releasable connection with said at least one further small container is provided on at least one end face of the small container.

7. Small container according to claim 6, wherein the coupling element is a bayonet catch-like structural part.

8. Small container according to claim 1, wherein a stop means is provided on the small container adjacent one end of said connecting means.

* * * * *